United States Patent [19]

Rose

[11] Patent Number: 4,910,904

[45] Date of Patent: Mar. 27, 1990

[54] RECOIL REDUCER FOR FIREARMS

[75] Inventor: Clyde E. Rose, South Weber, Utah

[73] Assignee: Browning, Morgan, Utah

[21] Appl. No.: 329,301

[22] Filed: Mar. 27, 1989

[51] Int. Cl.[4] ..... F41C 23/00

[52] U.S. Cl. ..... 42/74; 42/73

[58] Field of Search ..... 42/73, 74

[56] References Cited

U.S. PATENT DOCUMENTS

| | | | |
|---|---|---|---|
| 935,163 | 9/1909 | Parker | 42/74 |
| 2,731,753 | 1/1956 | Mathieu | 42/74 |
| 3,290,815 | 12/1966 | Edwards . | |
| 3,300,889 | 1/1967 | Baker . | |
| 3,381,405 | 5/1968 | Edwards . | |
| 3,442,042 | 5/1969 | Van Tyle Gilbert | 42/73 |
| 3,683,534 | 8/1972 | Davis . | |
| 4,279,091 | 7/1981 | Edwards . | |

*Primary Examiner*—Charles T. Jordan
*Assistant Examiner*—Richard W. Wendtland

[57] ABSTRACT

A pair of oppositely oriented cylinders are telescopically arranged to contain an assembly of piston, plunger and springs. One of the cylinders carries a recoil pad, and the other cylinder is mounted within the butt end of a firearm stock. Recoil forces are interrupted in their transfer to the recoil pad by operation of the assembly.

30 Claims, 3 Drawing Sheets

RECOIL REDUCER FOR FIREARMS

BACKGROUND OF THE INVENTION

1. Field

This invention relates to firearms and is particularly directed to a mechanism which reduces the recoil forces felt by a shooter discharging a firearm, particularly a shotgun.

2. State of the Art

When firearms, particularly rifles and shotguns, are discharged, recoil forces are generated which are felt on the shoulder of the shooter. Numerous efforts have been undertaken to bring about the reduction, if not the total elimination, of recoil felt at the recoil pad of a firearm. None of these efforts has been of material effectiveness in a practical context, however. Accordingly, sports enthusiasts, soldiers and other gunners have come to expect and accept the shock of recoil upon the discharge of a rifle, shotgun or similar shoulder-mounted firearm. Such recoil is associated with physical discomfort, inaccuracy (due to involuntary "jump") and anxious anticipation.

U.S. Pat. Nos. 3,290,815 and 3,381,405 disclose recoil reducing mechanisms which include a cylinder mounted within the stock of a firearm parallel the longitudinal axis of the barrel. Such a mechanism includes a relatively heavy piston between opposed springs. The relatively massive piston thus reciprocates within the sleeve to absorb recoil energy. U.S. Pat. No. 3,330,889 discloses a similar inertial responsive mass within a cylindrical sleeve with an air bleed orifice provided through the inertial mass. The air bleed accommodates movement of the mass within the cylinder without the development of air locks.

U.S. Pat. Nos. 3,290,815; 3,330,889; 3,381,405; 3,683,534; and 4,279,091 each disclose a recoil reducing mechanism which employs a movable mass with a spring on each side of that mass. The disclosures of each of these patents is incorporated by reference as a portion of this disclosure for their respective teachings concerning the problems associated with recoil and the manner in which recoil reducing mechanisms are commonly installed within the stock of a firearm.

None of the systems utilized heretofore to reduce the recoil forces (developed during the discharge of a firearm) translated to the shoulder of a gunner, (typically through a recoil pad), has been effective. There remains a need for a recoil reducing system which will dampen the peak recoil felt by a gunner to an appreciable extent. There also remains a need for a system which avoids the sensation of short-term peak force development characteristically experienced by gunners discharging firearms equipped with recoil reducing mechanisms of the prior art.

SUMMARY OF THE INVENTION

The present invention provides a recoil reducing mechanism which finds use in firearms of the type which include a barrel with a longitudinal axis supported by a stock which has a major axis approximately parallel the longitudinal axis of the barrel. Although the disclosure will be directed primarily to shotguns to avoid redundancy, it should e understood that the mechanism has general application to shoulder-mounted firearms, including rifles, shotguns, submachine guns and the like.

When a firearm is discharged, the recoil forces generated in the barrel are translated to the butt end of the stock resting against the shoulder of a shooter or gunner. The portion of the stock contacting the gunner's shoulder is regarded as a recoil pad and for purposes of this disclosure will be regarded as a separate element although it is recognized that in many instances the recoil pad is integral wit the stock. The butt end of the stock is thus considered to be the portion of the stock which interfaces with the recoil pad.

According to this invention, the recoil pad is carried by or comprises a separate structure which attaches to one of two telescoping cylinders. The two cylinders together comprise a recoil reducing mechanism of this invention. For purposes of this disclosure, the cylinders described and illustrated have a circular cross-section. Although it is recognized that other cross-sectional configurations of the cylinders and other components are operable, the most practical components for devices of this invention will ordinarily be circular in cross-sectional configuration.

A first hollow cylinder is mounted substantially within the stock. This cylinder should be oriented approximately parallel the longitudinal axis of the barrel of the firearm, although considerable departure from an exactly parallel orientation is permissible. It is generally preferred that the recoil forces operate approximately axially with respect to the cylinders included within the mechanism of this invention. The cylinder mounted within the stock will have a first end oriented towards the muzzle end of the firearm. This first end will usually be closed, although the closure for this first end may be the bottom of a bore in the stock itself. In any event, the second end of the first cylinder will be in open communication with the exterior of the butt end of the stock.

A second hollow cylinder is telescopically inserted within the first cylinder so that it can reciprocally move back and forth with respect to the first cylinder along a common axis. One end of the second cylinder extends out beyond the butt plate and is attached to a fixture carrying or otherwise associated with the recoil pad. Although structures are within contemplation in which the second cylinder has a larger diameter than the first cylinder, the most practical constructions usually insert the second cylinder within the first cylinder, and this disclosure will make specific reference to such structures.

Upon discharging the firearm, recoil forces cause telescoping reciprocal movement of the first and second cylinders with respect to each other; that is, the effective length of the two cylinders as a unit first decreases, against internally housed mechanism, and then increases to its original static length by the reaction of the internal mechanism. The internal mechanism may be regarded as force transfer means comprising a number of interactive components, including a piston, a plunger, and first and second biasing means. A piston, which is typically formed as a solid prism with internal bores, is mounted concentrically and reciprocally with respect to the common axis of the first and second cylinders. The piston thus has opposite ends, each of which is approximately transverse that axis. The piston is mounted within one of the cylinders with the first biasing means mounted between a first end of the piston and a first end of the cylinder, thereby to urge the second end of the piston towards the second end of the same cylinder.

A second biasing means is mounted between the first end of the other of said cylinders and a reaction surface isolated from the piston. Thus the second biasing means acts to urge the opposite ends of the assembled cylinders away from each other without directly contacting the piston.

A plunger element is mounted in association with the second biasing means. The plunger has a first end bearing upon the first end of the second cylinder and a second end which, in static condition, normally bears upon the second end of the piston in opposition to the first biasing means. As so arranged, upon discharge of the firearm (with the recoil pad held against the shoulder of a shooter), the first and second cylinders tend to telescopically close, thereby causing the plunger to push upon the piston. Both of the biasing means, typically coil springs, are forced against their bias, thereby absorbing some of the recoil energy.

Interruption means is operably associated with the interface between the second end of the plunger and the second end of the piston. This interruption means is operable (as the first ends of the cylinders move towards each other in response to recoil forces) to move the plunger out of contact with the piston, thereby permitting the plunger to advance towards the first biasing means independent of the piston. By "advancing towards" is meant decreasing the distance between the end of the plunger and the closest end of the biasing means. This decreased spacing may result from travel of the plunger or movement of the spring in reaction to its normal bias. A cushion means is mounted in association with the piston for contact by the plunger as the plunger advances towards the biasing means, thereby stopping further such advancement.

In the absence of recoil, the cylinders are urged away from each other; that is, into their telescopically advanced static positions, under the urging of the first and second biasing means. Travel is limited by means associated with the first and second cylinders to restrict separation of the cylinders under the influence of the biasing means (in the absence of additional recoil forces).

According to certain preferred embodiments of the invention, the recoil pad is carried by a fixture which is attached to the second cylinder; that is, the portion of the assembly projecting from the butt end of the stock, by adjustable means. The distance between the forward surface of the trigger carried at the fore end of the stock and the rearward surface of the recoil pad may thus be selectively increased or decreased between limits. An ideal arrangement for this purpose comprises a threaded interface between the first end of the second cylinder and threaded structure connected to the recoil pad. Means may also be provided whereby the attitude, i.e. the camber orientation of the recoil pad may be releasably established with respect to the stock. In this fashion, the same stock may be altered to accommodate left-hand or right-hand gunners.

BRIEF DESCRIPTION OF THE DRAWINGS

In the drawings, which illustrate what is currently regarded as the best mode for carrying out the invention.

DESCRIPTION OF THE ILLUSTRATED EMBODIMENT

Figure 1:
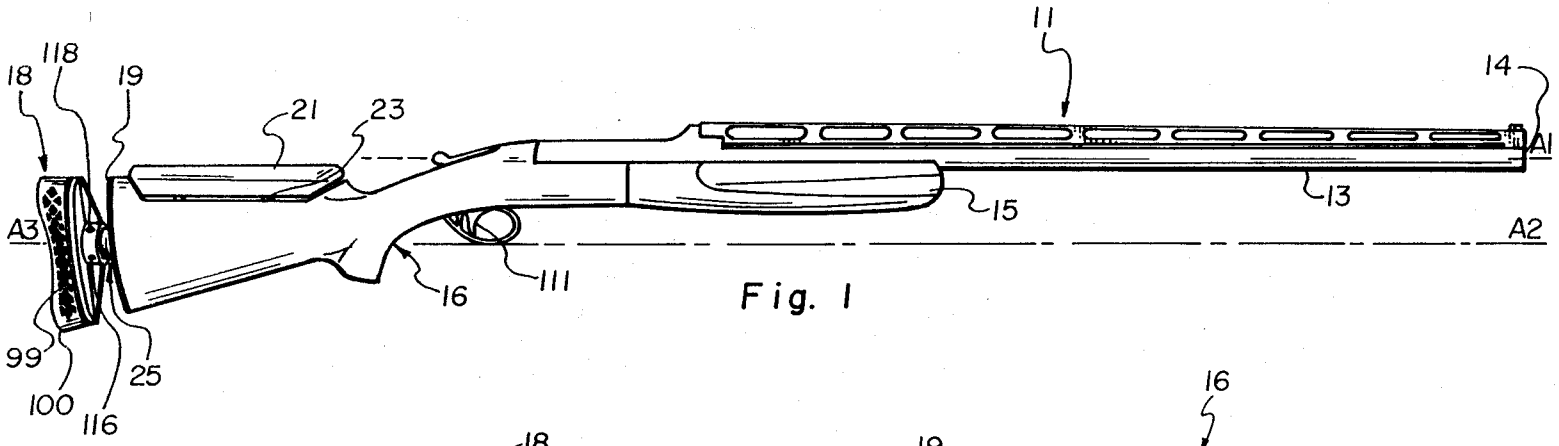
FIG. 1 is a perspective view of a firearm adapted to one embodiment of the invention.

As best illustrated by FIG. 1, a typical firearm, designated generally 11, of this invention includes a barrel 13 mounted at the fore end 15 of a stock, designated generally 16. A recoil pad assembly, designated generally 18, is mounted to the butt end 19 of the stock 16. As illustrated, the stock 16 also includes an adjustable cheek plate 21 which may be raised or lowered as desired on posts 23.

The barrel has a longitudinal central axis, designated A1, and the stock has a longitudinal axis, designated A2, which is approximately parallel the barrel axis A1. The axis A2 assumes an imaginary "rough" stock of rectangular prism configuration from which the finished stock 16 is cut. The recoil pad assembly 18 is suspended from the cantilevered end of an assembly, designated generally 25 (FIG. 2), of this invention. The assembly 25 also has a longitudinal central axis, designated A3, which is approximately parallel the axes A1 and A2 and in many instances may be congruent with the longitudinal major axis A2 of the stock 16. The assembly 25 includes a first cylinder 30 with a first end 31 oriented toward the muzzle 14 and a second end 32 in open communication with the exterior of the butt end 19 of the stock 16. A flange 34 carried by the cylinder 30 is attached, e.g. by screws 36, passing through holes 37 in the flange 34 (FIG. 5), to the butt end 19 of the stock 16, with the major portion of the cylinder 30 mounted within the bore 38.

A second cylinder 40 has a first end 41 threaded, as shown, to connect to a threaded structure 43 carried by the recoil pad assembly 18. In assembled condition, (FIGS. 2 and 4), the second cylinder 40 is telescopically received by the first cylinder 30, travel between the first and second cylinders 30, 40 being limited by set screws 45 traveling in slots 46.

Figure 4:
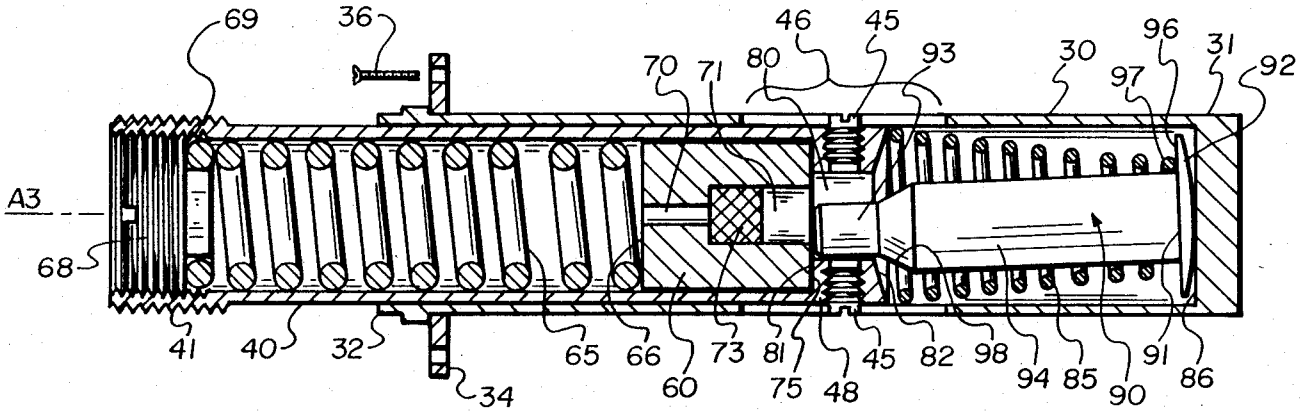
FIG. 4 is a view in cross-section of the components of FIG. 3 shown in assembled condition.

As best shown by FIG. 4, the set screws 45 are turned into a second end 48 of the second cylinder 40.

A piston 60, configured as a cylindrical plug, is inserted within the second cylinder 40 and is biased towards the first end of the first cylinder 30 by means of a first spring 65 positioned between the first end 66 of the piston 60 and the first end 41 of the cylinder 40. As shown, the first end 41 of the cylinder 40 is closed by a slotted plug 68, thereby containing the spring 65 and piston 60 within the cylinder 40 and providing a bearing surface 69 for the spring 65.

The piston 60 is provided with an axial bore 70, for pressure relief, and a well 71, which accommodates a cushion element 73 at its bottom. The well 71 is a bore in open communication with the second end 75 of the piston, thereby effecting an annular configuration for the surface 75 defined by the circular perimeters of the well 71 and piston 60 respectively. The cylinder end 48 also accommodates an opening 80 which may also be a bore, thereby defining opposed annular surfaces 81 and 82 (FIG. 4). A second spring 85 is mounted between a bearing surface 86 at the first end 31 of the first cylinder 30 and the surface 82, thereby tending to urge the first end 31 of the first cylinder and the first end 41 of the second cylinder 40 away from each other, (in the absence of counteracting forces, specifically the recoil forces resulting from discharging the firearm 11).

A plunger, designated generally 90, is mounted internally and approximately axially with respect to the spring 85. As shown, the plunger 90 has a first end 91 with a surface 92 held against the bearing surface 86. The plunger 90 has a second end 93 shown necked down with respect to the main body 94 and resting normally against the annular surface 75 of the piston 60. The plunger end 91 is configured as orientation structure interposed between the spring 85 and the bearing surface 86. The bearing surface 92 carried by the orientation structure 91 is configured to permit tilting of the plunger 94 with respect to the axis A3. The surface 96 opposite the bearing surface 92 of the orientation structure 91 is contacted unevenly by the end coil 97 of the spring 85, thereby exerting uneven force against the pressure surface 86, inevitably urging the second end of the plunger out of registration with the well 71, as shown in FIG. 4.

A camming surface 98 connects the body 94 and end 93 of the plunger 90. This camming surface 98 is interactive with the surface 82 so that as the plunger 90 is caused to move towards the end 41 of the cylinder 40 under the influence of recoil forces, the end 93 is cammed over into registration with the well 71, eventually contacting the cushion element 73.

When recoil commences, forces at the muzzle 14 are felt at the recoil pad 99 integral with the recoil pad assembly 18. The sensed force at the rear surface 100 of the pad 99 is transferred through the assembly 25 which effects a substantial reduction in and spreading of the forces actually generated. Upon commencement of recoil, cylinders 30 and 40 move with respect to each other, thereby causing the plunger 90 to move the piston 60 against the spring 65, compressing the spring 65 against the plug 68. Movement of the plunger 90, however, effects a movement of the end 93 into an axial position, due to the interaction of the surfaces 82, 98. The end 93 of plunger 90 thus enters the well 71. Upon this occurrence, the recoil force felt at the pad 99 is interrupted and momentarily reduced, as shown by the curve 105 of FIG. 6. With the plunger end 93 in the well 71, and out of contact with either the surface 81 or the cushion 73, the spring 65 reverses the direction of movement of the piston 60, resulting in an actual recoil reduction when the plunger end 93 ultimately contacts the padded element 73. In the absence of recoil forces, the relative movement between the cylinders 30 and 40 is reversed so that the ends 31 and 41 are urged apart by the springs 65 and 85. This reverse movement is limited by the set screws 45 riding in slots 46. Sufficient reverse movement is permitted so that the plunger 90 withdraws through the opening passageway 80 beyond the camming surface 98. Thus, the plunger end 93 is reset against the annular surface 81 of the piston 60. Repetitious reciprocal movements of the components as described under repetitive recoils causes the spring 85 to rotate slightly around the axis A3, thereby ensuring against undue localized wear.

Figure 6:
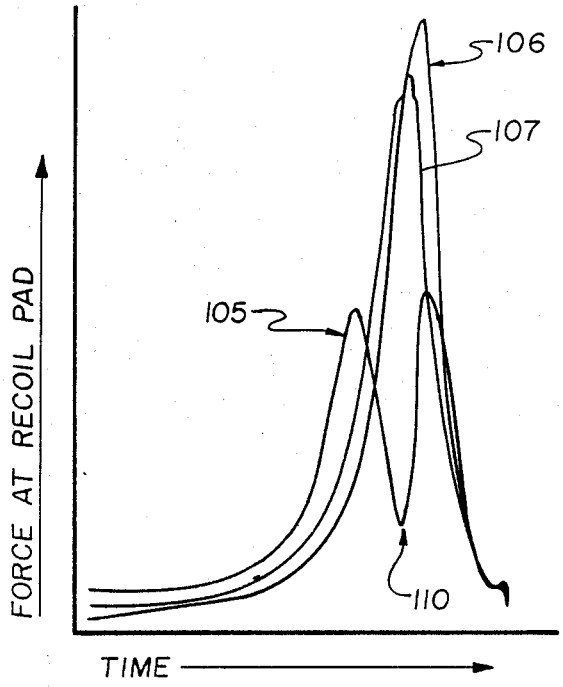
FIG. 6 is a time force graph comparing plots of recoil forces felt at the recoil pad of a firearm variously equipped with respect to recoil reduction.

FIG. 6 compares the force-time curves measured with the same gun variously outfitted with respect to recoil. The curve 105 illustrates the recoil forces felt at the recoil pad of a standard BT-99 Browning shotgun with the assembly of this invention installed as described. The curve 106 is a similar plot with a substantially identical gun utilizing no recoil reducing expedients. By comparison, the curve 107 is a similar plot with a substantially identical gun outfitted with a commercially available recoil device of the type described in earlier portions of this disclosure. The minimum 110 illustrated in the curve 105 occurs during the period after the plunger end 93 has entered the well 71 and prior to contact by the plunger with the element 73.

A notable characteristic of this invention is its functioning to spread the total force generated over a longer period of time, while cutting the peak force sensed very substantially. The perception of a gunner is that recoil forces have substantially diminished, thereby avoiding or obviating the problems experienced by prior art expedients.

Figure 2:
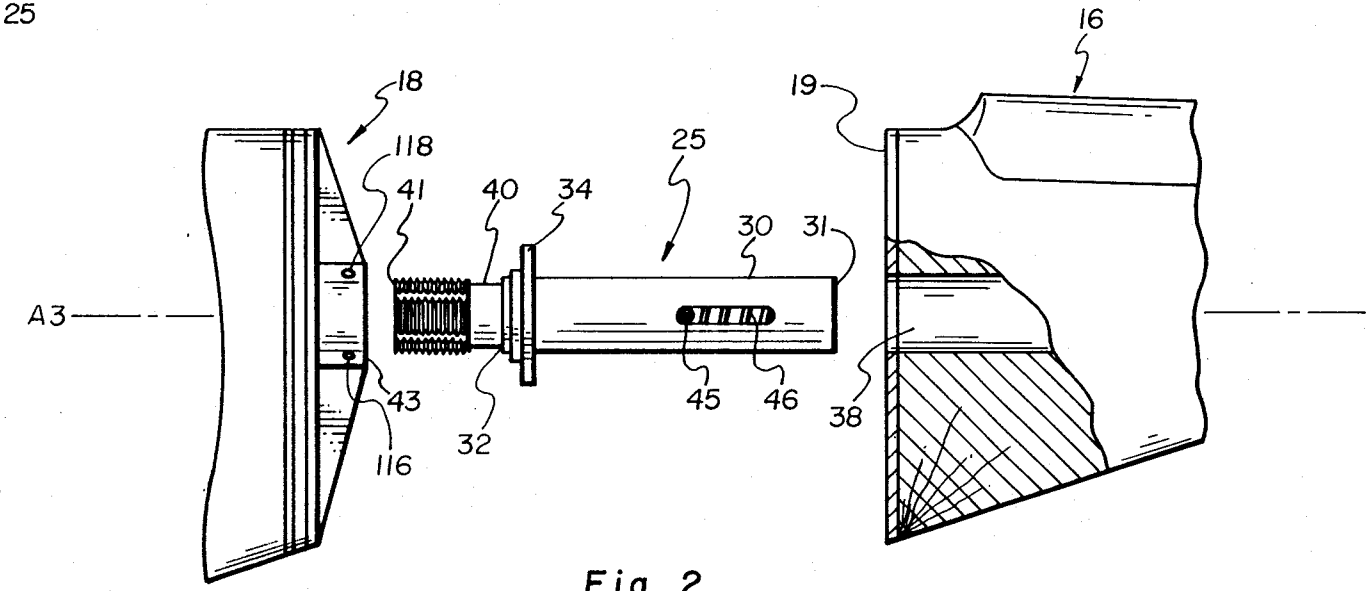
FIG. 2 is an exploded perspective view showing major components of the invention.
Figure 3:
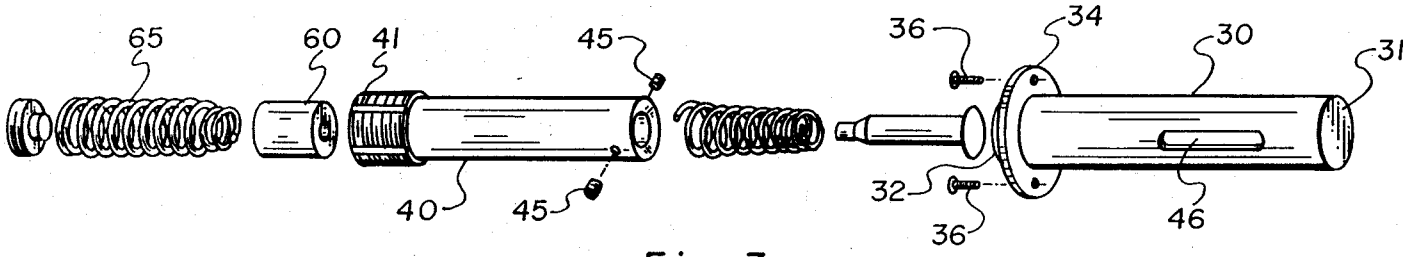
FIG. 3 is an exploded view showing internal parts of the major components of FIG. 2.
Figure 5:
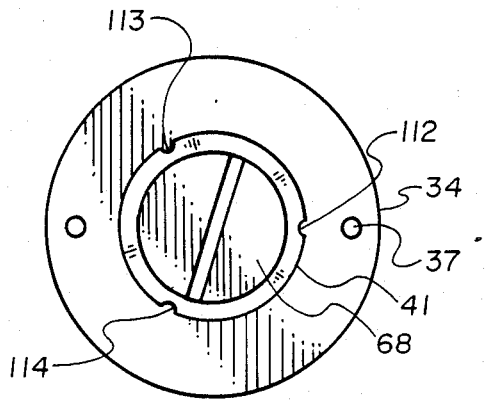
FIG. 5 is a view in elevation from the left side of the assembly as shown in FIG. 4.

FIGS. 2 and 5 best illustrate the adjustable length of pull and camber adjustments provided by the structure of this invention. The length of pull adjustment is achieved by turning the threaded end 41 selectively further in or out of a corresponding threaded structure 43 of the recoil pad assembly 18. In this fashion, the distance between the forward surface of the trigger 111 and the rearward surface 100 of the recoil pad 99 may be adjusted within limits. Referring specifically to FIG. 5, longitudinal grooves 112, 113, 114 are provided in the end 41 for selective registration with detents 116, 118, carried by the structure 43. Presently preferred detents are set screws turned in threaded holes. In any event, at zero camber, a single set screw may be placed in registration with the groove 112. For a right or left camber, the assembly 18 is tilted slightly (e.g. about 25°–30° from vertical) and a set screw may be registered with either of the grooves 113 or 114.

Reference herein to specific details of the illustrated embodiment is not intended to limit the scope of the appended claims which themselves recite those features regarded as important to the invention.

What is claimed:

1. A recoil reducing mechanism for firearms of the type which have a stock supporting a barrel and trigger at the fore end of said stock and a recoil pad at the butt end of said stock, said barrel having a first longitudinal axis which is approximately parallel a second axis, said second axis constituting the major axis of said stock so that recoil forces resulting from the discharge of said firearm act upon said recoil pad, the improvement which comprises:

a first hollow cylinder mounted substantially within said stock approximately parallel said first longitudinal axis, said first cylinder having a first end oriented towards said barrel and a second end in open communication with the exterior of said butt end of said stock;

a second hollow cylinder with a first end carrying said recoil pad and a second end inserted through said second end of said first cylinder so that said second cylinder is reciprocably mounted within said first cylinder along a third axis, said third axis constituting the common longitudinal axis of said first and second cylinders, whereby said recoil forces act upon said recoil pad through said first and second cylinders, thereby urging the respective said first ends of said cylinders towards each other;

force transfer means mounted within said first and second cylinders, including: a piston mounted concentrically and reciprocally with respect to said third axis, said piston element having a first end and a second end, first biasing means mounted between said first end of said piston and a said first end of one of said cylinders, thereby to urge said second end of said piston towards the second end of said one of said cylinders, second biasing means mounted between the first end of the other said cylinder and a reaction surface isolated from said piston, thereby to urge said first ends of said cylinders away from each other, a plunger element mounted in association with said second biasing means, said plunger having a first end bearing upon said first end of said other said cylinder and a second end normally bearing upon said first biasing means, interruption means operably associated with said second end of said plunger and said second end of said piston, said interruption means being operable, as said first ends of said cylinders move towards each other in response to recoil forces, to move said second end of said plunger out of contact with said second surfaces of said piston, thereby permitting said plunger to advance cushion means associated with said piston mounted for contact by said second end of said plunger as said plunger advances towards said first biasing means, thereby stopping further such advancement; and travel limiting means operably associated with said first and second cylinders to restrict the separation of said first ends of said cylinders under the influence of said first and second biasing means in the absence of recoil forces.

2. An improvement according to claim 1 wherein said piston is configured as a cylindrical plug with an axial well communicating with said second end of said piston, and said second end of said plunger normally bears upon an annular surface defined between said well and the outer perimeter of said piston.

3. An improvement according to claim 2 wherein said cushion means comprises a padding element within said well.

4. An improvement according to claim 2 wherein said plunger carries a camming surface interactive with structure internal said other said cylinder to urge said second end of said plunger into registration with said well as said first ends of said cylinders move towards each other.

5. An improvement according to claim 4 wherein said cushion means comprises a padding element within said well.

6. An improvement according to claim 2 wherein said first end of said plunger carries orientation structure interposed between said second biasing means and a first bearing surface at said first end of said other cylinder, said orientation structure including a second bearing surface, in contact with said first bearing surface, and a pressure surface, in contact with said second biasing means.

7. An improvement according to claim 6 wherein said first and second bearing surfaces are cooperatively configured to permit said plunger to tilt with respect to said third axis and said second biasing means exerts uneven force against said pressure surface, thereby urging said second end of said plunger out of registration with said well.

8. An improvement according to claim 7 wherein said cushion means comprises a padding element within said well.

9. An improvement according to claim 7 wherein said plunger carries a camming surface interactive with structure internal said other said cylinder to urge said second end of said plunger into registration with said well as said first ends of said cylinders move towards each other.

10. An improvement according to claim 9 wherein said cushion means comprises a padding element within said well.

11. An improvement according to claim 1, wherein said first biasing means is mounted within said second cylinder and said second biasing means is mounted within said first cylinder.

12. An improvement according to claim 11 wherein said piston is mounted within said second cylinder and said second end of said second cylinder carries internal structure including a stop surface normally being in contact with said second end of said piston in the absence of recoil forces.

13. An improvement according to claim 12 wherein said internal structure is configured as an annular disc with a first annular surface constituting said stop surface and a second annular surface constituting a cam reaction surface, said annular surfaces defining opposite ends of a passageway through said internal structure; and said plunger is mounted for reciprocal movement through said passageway.

14. An improvement according to claim 13 wherein said plunger carries a camming surface interactive with said cam reaction surface as said plunger moves through said passageway towards said first end of said second cylinder, thereby to urge said second end of said plunger out of registration with said second surface of said piston.

15. An improvement according to claim 14 wherein said piston is configured as a cylindrical plug with an axial well communicating with said second end of said piston, and said second end of said plunger normally bears upon an annular surface defined between said well and the outer perimeter of said piston.

16. An improvement according to claim 15, wherein said second end of said plunger is urged by said camming and cam reaction surfaces into registration with said well.

17. An improvement according to claim 16 wherein said cushion means comprises a padding element within said well.

18. An improvement according to claim 17 wherein said plunger carries a camming surface interactive with structure internal said other said cylinder to urge said second end of said plunger into registration with said well as said first ends of said cylinders move towards each other.

19. An improvement according to claim 18 wherein said cushion means comprises a padding element within said well.

20. An improvement according to claim 16 wherein said first end of said plunger carries orientation structure interposed between said second biasing means and a first bearing surface at said first end of said other cylinder, said orientation structure including a second bearing surface, in contact with said first bearing surface, and a pressure surface, in contact with said second biasing means.

21. An improvement according to claim 20 wherein said first and second bearing surfaces are cooperatively configured to permit said plunger to tilt with respect to said third axis and said second biasing means exerts uneven force against said pressure surface, thereby urging said second end of said plunger out of registration with said well.

22. An improvement according to claim 21 wherein said cushion means comprises a padding element within said well.

23. An improvement according to claim 22 wherein said plunger carries a camming surface interactive with structure internal said other said cylinder to urge said second end of said plunger into registration with said well as said first ends of said cylinders move towards each other.

24. An improvement according to claim 23 wherein said piston is configured as a cylindrical plug with an axial well communicating with said second end of said piston, and said second end of said plunger normally bears upon an annular surface defined between said well and the outer perimeter of said piston.

25. An improvement according to claim 1 wherein said recoil pad is attached to said first end of said second cylinder by adjustable means whereby the distance between the forward surface of said trigger and the rearward surface of said recoil pad may be selectively increased or decreased between limits.

26. An improvement according to claim 25 wherein said adjustable means includes locking means for releasably establishing the camber orientation of said recoil pad with respect to said stock.

27. An improvement according to claim 25 wherein said adjustable means comprises a threaded interface between said first end of said second cylinder and threaded structure connected to said recoil pad.

28. An improvement according to claim 27 wherein said adjustable means includes locking means for releasably establishing the camber orientation of said recoil pad with respect to said stock.

29. An improvement according to claim 28 wherein said locking means comprises longitudinal slots parallel said third axis on the outer surface of said second cylinder and detent means carried by said threaded structure adjusted to register selectively with said slots.

30. An improvement according to claim 29 wherein said detent means comprises a set screw rotatable from external said threaded structure.

* * * * *